US011897670B2

(12) United States Patent
Dayioglu et al.

(10) Patent No.: US 11,897,670 B2
(45) Date of Patent: Feb. 13, 2024

(54) CONTAINER INCLUDING BOX AND SLEEVE WITH LOCKING MECHANISM

(71) Applicant: PHILIP MORRIS PRODUCTS S.A., Neuchatel (CH)

(72) Inventors: Onur Dayioglu, Neuchatel (CH); Julie Polier, Neuchatel (CH); Luiz Andre Rodrigues, Neuchatel (CH); Digvijay Singh, Pully (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 17/633,999

(22) PCT Filed: Aug. 14, 2020

(86) PCT No.: PCT/EP2020/072873
§ 371 (c)(1),
(2) Date: Feb. 9, 2022

(87) PCT Pub. No.: WO2021/032622
PCT Pub. Date: Feb. 25, 2021

(65) Prior Publication Data

US 2022/0315273 A1 Oct. 6, 2022

(30) Foreign Application Priority Data

Aug. 16, 2019 (EP) ..... 19192180

(51) Int. Cl.
*B65D 5/38* (2006.01)
*B65D 85/10* (2006.01)
*B65D 5/66* (2006.01)

(52) U.S. Cl.
CPC ..... *B65D 5/38* (2013.01); *B65D 5/6697* (2013.01); *B65D 85/10564* (2020.05)

(58) Field of Classification Search
CPC .. B65D 5/6697; B65D 5/38; B65D 85/10564; B65D 85/1036; B65D 55/02; B65D 2215/02; B65D 2215/00; B65D 2215/04
(Continued)

(56) References Cited

U.S. PATENT DOCUMENTS 4,534,463 A * 8/1985 Bouchard ..... B65D 85/1009 229/122
4,641,748 A * 2/1987 Lewis ..... B65D 85/1036 229/125.08

(Continued)

FOREIGN PATENT DOCUMENTS

EP 2305567 4/2011
IT B020100703 5/2012

(Continued)

OTHER PUBLICATIONS

Extended European Search Report for Application No. 19192180.8 dated Jun. 29, 2020 (10 pages).

(Continued)

*Primary Examiner* — Chun Hoi Cheung
(74) *Attorney, Agent, or Firm* — Mueting Raasch Group

(57) ABSTRACT

A container (1) for consumer goods, the container comprises an outer sleeve (20) and inner box (10) disposed within the outer sleeve (20), and configured to be slidable with respect to the outer sleeve (20) between: a first position, in which the interior of the inner box (10) cannot be accessed by a user; and a second position, in which the interior of the inner box (10) can be accessed by a user. The container (1) having a locking mechanism for preventing the inner box (10) from sliding from the first position to the second position, when the inner box (10) is in the first position in the outer sleeve (20).

16 Claims, 3 Drawing Sheets

(58) Field of Classification Search
USPC ..... 206/267, 1.5; 229/125.125
See application file for complete search history.

(56) References Cited

U.S. PATENT DOCUMENTS

| | | | | |
|---|---|---|---|---|
| 4,784,315 | A | 11/1988 | Dutscher | |
| 6,837,369 | B2 * | 1/2005 | Amos | B65D 85/1072 229/120.1 |
| 7,377,385 | B2 * | 5/2008 | Giannini | B65D 5/38 229/125.125 |
| 8,342,330 | B2 * | 1/2013 | Weston | B65D 77/0413 206/534 |
| 8,869,984 | B2 * | 10/2014 | Bellamah | B65D 83/0463 206/468 |
| 8,997,979 | B2 * | 4/2015 | Ghini | B65D 5/38 206/267 |
| 10,017,291 | B2 * | 7/2018 | Smith | B65D 5/728 |
| 10,618,683 | B2 * | 4/2020 | Jones | B65D 5/4266 |
| 2003/0085262 | A1 * | 5/2003 | Evans | B65D 77/02 206/532 |
| 2011/0163156 | A1 * | 7/2011 | Smith | B65D 83/0463 229/125.125 |
| 2013/0193029 | A1 * | 8/2013 | Weston | B65D 25/00 206/531 |
| 2014/0131234 | A1 * | 5/2014 | Ghini | B65B 61/18 206/267 |
| 2015/0307246 | A1 * | 10/2015 | Patwardhan | B65D 77/0433 206/1.5 |
| 2019/0062023 | A1 * | 2/2019 | Lantz | B65D 5/38 |
| 2020/0180808 | A1 * | 6/2020 | Gauvin | B65D 5/38 |
| 2021/0016939 | A1 * | 1/2021 | Palmer | B65D 5/44 |
| 2021/0031969 | A1 * | 2/2021 | Fahlke | B65D 50/046 |
| 2022/0055822 | A1 * | 2/2022 | Polloni | B65D 85/10564 |
| 2022/0144535 | A1 * | 5/2022 | Fradeani | B65D 85/1054 |
| 2022/0289425 | A1 * | 9/2022 | Green | B65D 5/0254 |

FOREIGN PATENT DOCUMENTS

| | | |
|---|---|---|
| JP | 2019 085118 | 6/2019 |
| KR | 20180002118 | 7/2018 |
| WO | WO 2008/054305 | 5/2008 |

OTHER PUBLICATIONS

PCT International Search Report and Written Opinion for PCT/EP2020/072873 dated Feb. 17, 2021 (15 pages).

* cited by examiner

CONTAINER INCLUDING BOX AND SLEEVE WITH LOCKING MECHANISM

This application is a U.S. National Stage Application of International Application No. PCT/EP2020/072873 filed Aug. 14, 2020, which was published in English on Feb. 25, 2021, as International Publication No. WO 2021/032622 A1. International Application No. PCT/EP2020/072873 claims priority to European Application No. 19192180.8 filed Aug. 16, 2019.

The present invention relates to a container for consumer goods. Containers according to the invention find particular application as containers for aerosol generating articles or components of aerosol generating articles.

It is known to package consumer articles in containers formed from folded laminar blanks. By way of example, elongate smoking articles, such as cigarettes and cigars, are often sold in rigid box shaped containers, such as hinged lid containers having a box portion and a three-dimensional cup shaped hinge lid connected to the box about a hinge line extending across the back wall of the container. In use, the lid is pivoted about the hinge line to open the pack and so gain access to the consumer articles held in the box.

It is also known to package consumer goods in containers comprising an outer shell or sleeve and an inner slide or box in which the consumer goods are housed and which is slidable within the outer shell. To remove consumer goods from such containers, a user slides the inner slide from an initial position within the outer shell to an open position in which the inner slide projects outwardly from the outer shell, in order to partially expose an open end or side of the inner slide. Such containers may be referred to as a slide-and-shell container.

It may be desirable to ensure that the inner slide or inner box remains enclosed within the outer shell until a user is ready to access the consumer goods. For example, it may be desirable to ensure that the lid remains in the closed position when the container is being transported. This may help to prevent the consumer goods from inadvertently falling out of the container. This may help to preserve one or more properties of the consumer goods, such as their freshness.

It would be desirable to provide a novel and improved container for consumer goods which is configured to reduce the risk of a lid of the container inadvertently moving from the closed position to the open position. Further, it would be desirable to provide one or more laminar blanks and a method for forming one such improved container, wherein the manufacturing process is straightforward and cost-effective.

According to the present disclosure, there is provided a container for consumer goods. The container comprises: an outer sleeve comprising an outer sleeve front wall, an outer sleeve back wall, first and second opposed outer sleeve side walls, and first open end; and an inner box disposed within the outer sleeve. The inner box is configured to be slidable with respect to the outer sleeve between: a first position, in which the interior of the inner box cannot be accessed by a user; and a second position, in which the interior of the inner box can be accessed by a user. Sliding of the inner box from the first position to the second position involves at least part of the inner box passing through the first open end of the outer sleeve. The inner box comprises an inner box top wall, an inner box bottom wall, an inner box front wall, an inner box back wall, first and second opposed inner box side walls, and an inner box engagement flap configured to overlie a portion of the outer surface of the inner box back wall. When the inner box is in the first position in the outer sleeve, an edge of the inner box engagement flap is configured to engage with a corresponding engaging element on the inner surface of the outer sleeve back wall, to form a locking mechanism for preventing the inner box from being slidable from the first position to the second position.

In some preferred embodiments, the inner box may be formed from two or more laminar blanks. The back wall of the inner box may be formed from a different laminar blank than the laminar blank which forms the inner box engagement flap. This may be advantageous from a manufacturing perspective, as it may allow the majority of the inner box to be formed from a conventional laminar blank. It may therefore be possible to form an inner box having the engagement flap, without substantially modifying existing components or processes.

Therefore, according to the present disclosure there is also provided a container for consumer goods. The container comprises: an outer sleeve comprising an outer sleeve front wall, an outer sleeve back wall, first and second opposed outer sleeve side walls, and first open end; and an inner box disposed within the outer sleeve. The inner box is configured to be slidable with respect to the outer sleeve between: a first position, in which the interior of the inner box cannot be accessed by a user; and a second position, in which the interior of the inner box can be accessed by a user. Sliding of the inner box from the first position to the second position involves at least part of the inner box passing through the first open end of the outer sleeve. The inner box comprises an inner box top wall, an inner box bottom wall, an inner box front wall, an inner box back wall, first and second opposed inner box side walls, and an inner box engagement flap configured to overlie a portion of the outer surface of the inner box back wall. When the inner box is in the first position in the outer sleeve, an edge of the inner box engagement flap is configured to engage with a corresponding engaging element on the inner surface of the outer sleeve back wall, to form a locking mechanism for preventing the inner box from being slidable from the first position to the second position. The inner box is formed from two or more laminar blanks, with the back wall of the inner box being formed from a different laminar blank than the laminar blank which forms the inner box engagement flap Such an inner box engagement flap and corresponding engaging element arrangement forms at least part of a locking mechanism for the container. By providing the container with such a locking mechanism the container can be left in a locked state, in which the interior of the inner box cannot be accessed. This means that the container can be locked when not in use. The locking mechanism may therefore help to reduce the risk of inadvertent opening of the container. This may help to prevent the consumer goods from inadvertently falling out of the container. This may help to preserve one or more properties of the consumer goods, such as their freshness.

By providing the container according to the present invention, at least part of the locking mechanism may be hidden from the outer appearance of the container. This can mean that the locking mechanism is less obviously visible. This may help to reduce the risk of the container becoming inadvertently unlocked. More specifically, because the inner box engagement flap is configured to engage with an engaging element on an inner surface of the outer sleeve back wall, the inner box engagement flap underlies the outer sleeve back wall and thus is at least partially hidden.

A locking element which has minimal or no visual impact on the outer appearance of the container may provide a number of advantages. For example, having minimal or no visual impact on the outer appearance of the container can help to prevent ingress of particles into the container, by minimising or avoiding cracks or gaps on the outer surface of the container. Furthermore, having minimal or no visual impact on the outer appearance of the container can help to ensure the outer surface of the container remains substantially smooth. This may be advantageous for one or both of transporting and manufacturing of the container. This may also be advantageous when printing the outer surface of the container.

The choice of using such a locking mechanism in a container having an inner box, which is slidable relative to an outer sleeve, can be particularly advantageous in reducing the risk of inadvertent opening of the container. This is because the action required to release the locking mechanism, may be a different action from the sliding action required to move the inner box relative to the outer sleeve. For example, a pressing action may be required to release the locking mechanism, whereas a sliding action may be required to move the inner box relative to the outer sleeve. The requirement for such different and distinct actions, can make it even less likely for the container to be opened inadvertently.

Providing the container with a locking mechanism having an engagement flap positioned at the back of the container may further help to the risk of inadvertent opening of the container. This is because the locking mechanism may not be immediately apparent when the container is viewed during normal handling, and in particular, when the container is looked at from a front view.

The locking mechanism of the present invention may be particularly advantageous in embodiments where the width of the container is greater than the height of the container. For example, preferably the width of the container is greater than 75 mm, more preferably the width of the container is greater than 80 mm, most preferably the width of the container is greater than 85 mm or 90 mm. The width of the container is preferably less than 200 mm, more preferably less than 150 mm. This is because in such embodiments, a user is less likely to hold both sides of the container at any one time. As such, the user is less likely to be applying a pressing force to both sides of the container at the same time, during normal handling of the container.

The edge of the inner box engagement flap, which is configured to engage with a corresponding engaging element on the outer sleeve back wall, is preferably a free edge of the inner box side flap. A free edge of a flap is one which does not directly connect the flap to the article from which it depends.

The free edge of the inner box side flap is preferably a leading edge of the inner box engagement flap. That is, the free edge of the inner box engagement flap, which is configured to engage with a corresponding engaging element on the outer sleeve back wall, is preferably positioned opposite to an edge of the inner box engagement flap which connects the inner box engagement flap to the rest of the inner box.

The inner box is configured to be slidable with respect to the outer sleeve. The outer sleeve may therefore have an interior configured to receive the inner box. The outer sleeve may comprise a second end positioned opposite to the first open end of the outer sleeve. The second end of the outer sleeve may comprise an outer sleeve bottom wall. Therefore, the outer sleeve may have a first open end, and a second end comprising the outer sleeve bottom wall, with the outer sleeve front wall, outer sleeve back wall and first and second opposed outer sleeve side walls extending between the first open end of the outer sleeve and the bottom wall of the outer sleeve.

The inner box is movable within the outer sleeve between: a first position, in which the interior of the inner box cannot be accessed by a user; and a second position, in which the interior of the inner box can be accessed by a user. The first position may therefore be regarded as a closed position. The second position may be regarded as an open position. When the inner box is in the second position, the interior of the inner box may be directly accessible for a user. That is, a user may not be required to do anything further to the container in order to be able to access any consumer goods held within the interior of the inner box. Alternatively, when the inner box is in the second position, a user may be required to move a lid of the inner box in order to access any consumer goods held within the interior of the inner box. For example, the inner box may comprise a box portion and a lid portion attached to the box portion, the lid portion being configured to cover an access opening of the box portion of the inner box. The lid portion may be moveable relative to the box portion between: a closed position, in which the lid portion covers the access opening of the box portion, and an open position, in which any consumer goods held within the interior of the box portion can be accessed via the access opening of the box portion. The lid portion may be hingedly connected to the box portion, and configured to pivot between the open position and the closed position.

The container may be configured so that the lid portion of the inner box cannot move between the open position and the closed position, when the inner box is in the first position. For example, when the inner box is in the first position, one or more walls of the outer sleeve may prevent the lid portion of the inner box from moving between the open position and the closed position. Put another way, said walls of the outer sleeve may act to retain the lid portion of the inner box in the closed position, when the inner box is in the first position.

Movement of the inner box from the first position to the second position may cause at least part of the inner box to pass through the first open end. In particular, at least part of the inner box is configured to slide through the access opening of the outer sleeve, and thus move externally of the outer sleeve, as the inner box moves from the first position to the second position. This can help to improve the ease of access to any consumer goods held in the inner box, when the inner box is in the second position.

The outer sleeve and the inner box may be configured so that the majority or all of the inner box is enclosed by the outer sleeve when the inner box is in the first position. This can help to minimise the amount of surface area of the inner box, which can be accessed by a user when the inner box is in the first position.

Preferably, the outer sleeve and the inner box are configured so that at least one of the inner box front wall and the inner box back wall completely underlies its corresponding outer sleeve front wall and outer sleeve back wall, when the inner box is in the first position. In such embodiments, at least one of the inner box front wall and the inner box back wall will not be visible to a user, when the inner box is in the first position. This may help to limit the amount of surface area of the inner box, which a user may be able to grip, in order to slide the inner box from the first position to the second position. This may help to reduce the risk of the container being inadvertently opened. This may also help to enhance the amount of uninterrupted surface area, which is available for communication with the user at one or both of the front or back of the container, when the inner box is in the first position.

Preferably, part of the inner box does reside outside of the outer sleeve when the inner box is in the first position. More preferably, between about 5 percent and about 20 percent of the external surface area of the inner box resides outside of the outer sleeve when the inner box is in the first position. This can advantageously ensure that whilst most of the inner box cannot be touched by a user, a portion of the inner box can still be gripped by a user, when the inner box is in the first position. This can provide an optimal balance between securing the inner box, and helping a user to slide the inner box away from the outer sleeve when they wish to access any consumer goods within the inner box.

The open end of the outer sleeve may be angled relative to the longitudinal axis of the outer sleeve. More specifically, the length of the outer sleeve front wall may be less than the length of the outer sleeve back wall. Each outer sleeve side wall may therefore have a different length at the point at which said outer sleeve side wall connects to the outer sleeve back wall compared to the point at which said outer sleeve side wall connects to the outer sleeve front wall. This can define a sloped edge for each side wall at the open end of the outer sleeve, said sloped edge of each outer sleeve side wall being sloped relative to the longitudinal axis of the outer sleeve. Such arrangements can advantageously help to ensure that some of the inner box can be gripped by a user when the inner box is in the first position, without requiring the inner box to have an unconventional shape. In particular, in such embodiments the inner box may have a rectangular parallelepiped shape. This may be preferable from a manufacturing perspective. This may also be preferable from a storage perspective.

In the following description of the invention the terms "side", "top", "bottom", "front", "back" and other terms used to describe relative positions of the components of containers according to the invention refer to the container in an upright position with the access opening at the top. When describing containers according to the present invention, these terms are used irrespective of the orientation of the container being described. The "bottom" of the container refers to the side of the container opposite the "top" of the container.

The term "height" is used herein to refer to dimensions extending between the top and the bottom. The term "width" is used herein to refer to dimensions extending between two sides. The term "depth" is used herein to refer to dimensions extending between the front and the back. Height, width and depth are orthogonal to each other.

The term "panel" is used herein to refer to a portion of the container formed from a single, continuous portion of material. A panel may depend from one or more other panels.

The term "wall" refers more generally to a facet of the container, and a wall may be formed from a single panel or flap, or a wall may be formed from two or more abutting or overlapping panels or flaps.

The term "depending" is used herein to describe a physical connection between two elements of a container in accordance with the invention. In more detail, the term "depending" is used to indicate that there is a material continuity between two elements, such as two walls or panels of a container or blank. This encompasses both cases wherein a wall or panel depends directly from an adjacent wall or panel as well as cases wherein an intermediate wall or panel effectively connects two walls or panels.

By way of example, a side wall or panel may depend directly from an adjacent front wall or panel. In such case, the wall or panel typically depends along a fold line from the adjacent wall. As an alternative, especially in containers having curved or bevelled edges, a side wall or panel may depend indirectly from a front wall or panel. In such case a curved or bevelled edge wall or panel connects the side wall or panel and the front wall or panel. In the case of a bevelled edge, both side wall or panel and front wall or panel may depend from the connecting bevelled edge wall or panel along respective fold lines. This also applies to optional components of containers in accordance with the invention, for example to a reinforcing member provided in the form of an inner frame.

The term "hinge line" is used herein to refer to a line about which the lid may be pivoted in order to open the container. A hinge line may be, for example, a fold line or a score line. The hinge line about which the lid is connected to the box may coincide with an edge of the container, or the hinge line may extend across a wall of the container at a position that is spaced apart from the edges.

The term "inner surface" is used throughout the specification to refer to the surface of a component of the assembled container that is facing towards the interior of the container, for example towards the consumer goods, when the container is in the closed position. The term "outer surface" is used throughout the specification to refer to the surface of a component of the container that is facing towards the exterior of the container. For example, the front wall of the package has an inner surface that is facing the inside of the package and the consumer goods, and an outer surface facing away from the consumer goods. It should be noted that the inside or outside surface is not necessarily equivalent to a certain side of a blank used in assembly of the container. Depending on how the blank is folded around the consumer goods, areas that are on the same side of the blank can either face towards the inside or the towards the outside of the container.

The term "fold line" is used to describe any line of a blank about which the blank is folded. The fold line may be defined by a line of weakness to assist with the folding action. Alternatively, a fold can be formed without the presence of a weakening line, depending for example on the pliability of the blank material and other material characteristics.

When the locking mechanism of the container is engaged, the inner box is prevented from sliding from the first position to the second position with respect to the outer sleeve. Disengagement of the locking mechanism enables the inner box to slide with respect to the outer sleeve from the first position to the second position. Therefore, the container may be configured so that disengagement of the inner box engagement flap from its corresponding engaging element, allows the inner box to slide with respect to the outer sleeve from the first position to the second position.

In some embodiments, the inner box is formed from: a first laminar blank comprising a back wall panel for forming the inner box back wall; and a second laminar blank comprising a first panel for forming the engagement flap and a second panel for securing the first panel to the inner box back wall. The first panel may be connected to the second panel by a fold line.

The second panel may itself be secured to the outer surface of the inner box back wall by an adhesive.

The outer sleeve back wall may be provided with a release element for enabling the edge of the inner box engagement flap to disengage from the corresponding engaging element on the inner surface of the outer sleeve back wall. Put another way, the release element may be configured to enable the locking mechanism to transition from a locked state to an unlocked state in response to pressure exerted on the container by a user. In particular, the release element is configured to enable a user to interact with the locking mechanism to instigate such a transition. Preferably, when the inner box is in the first position, the release element of the outer sleeve overlies at least a portion of its corresponding inner box engagement flap.

In some embodiments, the release element may comprise a cut-out in the outer sleeve back wall. The cut-out may be positioned adjacent to a portion of a corresponding inner box engagement flap, when the inner box is in the first position. In such embodiments, the cut-out can allow a user to directly access the inner box engagement flap and disengage it from the engaging element on the inner surface of the outer sleeve back wall. In particular, a user may insert their finger through the cut-out and push the inner box engagement flap away from the engaging element on the inner surface of the outer sleeve back wall to unlock the locking mechanism.

In some embodiments, the release element comprises a release tab formed by at least one cut line in an outer sleeve back wall. For example, the outer sleeve back wall may comprise a cut, which defines at least part of the perimeter of a release tab in said wall. The cut may be a U-shaped cut. The cut may be an arcuate cut. The release tab may be deflectable relative to the remainder of its outer sleeve back wall. This can allow the release tab to be moved independent of its outer sleeve back wall, in response to pressure from a user. The release tab may be positioned adjacent to a portion of the inner box engagement flap, when the inner box is in the first position. Thus, in use, a user can press on the release tab to translate a force to the inner box engagement flap to disengage the inner box engagement flap from the engaging element on the inner surface of the outer sleeve back wall.

By providing a release element in the form of a release tab, the means for unlocking the locking mechanism can be incorporated into the container with minimal visual impact on the container. The means for unlocking the container may therefore not be obviously visually apparent. This may therefore help to reduce the risk of the container being inadvertently opened The inner surface of the outer sleeve back wall comprises an engaging element for engaging with an edge of the inner box engagement flap, when the inner box is in the first position in the outer sleeve. The engaging element provides a barrier for engaging with the inner box engagement flap. In particular, the barrier may provide an engagement edge configured to abut the edge of the inner box engagement flap. The engaging element may be integrally formed with the outer sleeve back wall. For example, the outer sleeve back wall may be manufactured with a raised portion having an increased thickness to provide its engaging element. Alternatively, the engaging element may comprise an element affixed to the inner surface of the outer sleeve back wall. The element may comprise a strip of material extending across the inner surface of the outer sleeve back wall.

The engaging element may be formed from a panel which is secured to part of the inner surface of the outer sleeve back wall. The engaging element may comprise a panel affixed to the inner surface of the outer sleeve back wall. The panel may be connected to the outer sleeve back wall by a fold line, and folded about the fold line by about 180 degrees relative to the outer sleeve back wall.

The container may further comprise a holding mechanism for preventing the inner box from sliding beyond the second position. The holding mechanism may prevent the inner box from being separated from the outer sleeve. The holding mechanism may prevent the inner box from being completely removed from the outer sleeve.

The holding mechanism may advantageously provide a user with an indication that the inner box has reached the second position. More specifically, when the holding mechanism engages to prevent the inner box from sliding beyond the second position, the user may be provided with a tactile indication that the inner box has reached the second position. This may give a user an indication that the inner box is in a position in which they can access the consumer goods.

In some embodiments, the holding mechanism comprises an extendable member connecting a wall of the inner box to a wall of the outer sleeve. The extendable member is configured to change between a retracted state when the inner box is in the first position, and an extended state when the inner box is in the second position. The extendable member may be provided in the form of a strip of folded panels, with a first end panel of the strip being secured to a part of the outer sleeve and a second opposing end panel of the strip being secured to a part of the inner box. For example, the first end panel of the strip may be secured to the inner surface of an outer sleeve wall, such as an outer sleeve bottom wall. The second end panel may be secured to the outer surface of an inner box wall, such as the inner box bottom wall or the inner box top wall. The extendable member may therefore be concertina-like when it changes between its retracted and extended configurations.

The holding mechanism may comprise a flap on the outer sleeve, which is configured to engage with a corresponding edge on the inner box to prevent the inner box from sliding beyond the second position. In particular, the flap may be configured to engage an edge of the inner box when the inner box is in the second position, to prevent the inner box from sliding beyond the second position.

The flap on the outer sleeve may depend from an edge of one of the outer sleeve walls. The flap on the outer sleeve may depend from an edge of the outer sleeve front wall. The flap on the outer sleeve may depend from an edge of the outer sleeve, disposed at the open end of the outer sleeve. The flap on the outer sleeve may depend from a fold line on the outer sleeve, the fold line forming an edge of one of the outer sleeve walls. The flap on the outer sleeve may extend into the interior of the outer sleeve. For example, the flap may extend into the interior of the outer sleeve. The flap may be biased away from the wall from which it depends. The flap may have a contoured leading edge, for example a curved leading edge. This may facilitate engagement of the flap with the corresponding edge on the inner box.

In some embodiments, the flap on the outer sleeve depends from a fold line forming an edge of the outer sleeve front wall, the edge being disposed proximate to the outer sleeve opening and the flap extending into the interior of the outer sleeve and away from the outer sleeve front wall.

A flap having one or more of the above described features can provide a number of advantages. For example, the flap may be easy to manufacture, particularly if the flap depends from one of the existing walls of the outer sleeve. By arranging for the flap to depend from a fold line on the outer sleeve, the flap may be generally biased towards engagement with the edge on the inner box. This is particularly applicable when the flap extends into the interior of the outer sleeve and projects away from the wall from which it depends.

The holding edge of the inner box may be formed by a cut line on one of the walls of the inner box. The holding edge of the inner box may be formed by a cut line on the inner box back wall. The cut line may have an arcuate shape. For example, in some embodiments, the edge is formed from a cut line in the back wall or front wall of the inner box. By way of example, in some embodiments, the edge is formed from an arcuate cut line in the back wall of the inner box.

The inner box may comprise a box portion and a lid portion connected to the box portion by a hinge line. In such embodiments, the edge on the inner box, which is configured to engage with a flap on the outer sleeve may be formed by an edge of the lid portion of the inner box. In such embodiments, the lid portion may engage with the flap when the inner box is in the second position and be held in a fixed position relative to the outer sleeve. However, advantageously, in such a position, the box portion of the inner box may be able to pivot about the hinge line to permit access to the interior of the inner box and any consumer goods housed therein. Accordingly, in such embodiments a user may be able to slide the inner box to the second position, and then pivot the box portion relative to the lid portion and outer sleeve to gain access to the interior of the inner box.

The box portion of the inner box may comprise a box portion front wall, box portion top wall, and first and second opposing box portion side walls. The box portion may have an interior configured to house one or more consumer goods.

The lid portion of the inner box may comprise a lid portion front wall, a lid portion back wall, a lid portion top wall and first and second opposing lid portion side walls. These walls may together provide the lid portion with a three-dimensional cup shaped lid.

The lid portion front wall, lid portion back wall and lid portion side walls may each abut corresponding walls of the box portion of the inner box, when the lid portion is in the closed position. The lid portion front wall, lid portion back wall and lid portion side walls may each be flush with the corresponding walls of the box portion of the inner box, when the lid portion is in the closed position.

The holding edge of the lid portion of the inner box which is configured to engage with a flap on the outer sleeve, may be the lower edge of the lid portion front wall.

The flap of the outer sleeve may extend under the lid portion front wall when the inner box is in the second position. In such embodiments, the lid portion top wall may comprise a slot through which the leading edge of the flap of the outer sleeve extends when the inner box is in the second position. This may advantageously provide a point of engagement between the flap of the outer sleeve and the lid portion of the inner box. In particular, this may help to ensure that the flap of the outer sleeve can engage with the lid portion of the inner box in a reliable and consistent manner. In addition, the engagement may also help to reduce or avoid any relative movements between the lid portion of the inner box and the outer sleeve, when the inner box is in the second position. The slot may be provided proximate to the edge of the lid portion connecting the lid portion top wall and lid portion front wall. Such a position may be advantageous, because it can help to ensure that the flap of the outer sleeve lies flush against the inner surface of the lid portion front wall, when the inner box is in the second position. This may help to minimise the risk of the flap of the outer sleeve from interfering with other portions of the inner box, or any consumer goods container therein.

As noted above, the inner box may comprise: a box portion comprising a box portion bottom wall, a box portion front wall, a box portion back wall, and first and second opposed box portion side walls; and a lid portion hingedly attached to the box portion by a hinge line, the lid portion comprising a lid portion top wall, a lid portion front wall, a lid portion back wall, and first and second opposed lid portion side walls. In such embodiments, the container may be configured so that one or both of the hinge line of the inner box and the lower edge of the lid portion front wall underlies a corresponding one of the outer sleeve front wall and outer sleeve back wall is enclosed within the outer sleeve, when the inner box is in the first position. Such an arrangement can advantageously mean that the lid portion of the inner box is prevented from pivoting relative to the box portion of the inner box, when the inner box is in the first position. This can mean that a user is prevented from accessing any consumer goods held within the inner box, when the inner box is in the first position. In such embodiments, the container may be further configured so that one or both of the hinge line of the inner box and the lower edge of the lid portion front wall is positioned externally of the outer sleeve, when the inner box is in the second position. Such an arrangement can advantageously mean that the lid portion of the inner box is able to pivot relative to the box portion of the inner box, when the inner box is in the second position. This may allow a user to access any consumer goods held within the inner box, when the inner box is in the second position.

The inner box engagement flap may be configured to overlie a portion of the outer surface of the lid portion back wall. Alternatively or additionally, the inner box engagement flap may be configured to overlie a portion of the outer surface of the box portion back wall.

The inner box engagement flap may be pivotable about a pivot line on the back wall of the inner box. The pivot line may directly connect the inner box engagement flap to a portion of the back wall of the inner box. Alternatively, the pivot line may connect the inner box engagement flap to a component, which is itself secured to the outer surface of the inner box back wall, for example by way of an adhesive. The component may be a panel. The panel may extend over only a portion of the outer surface of the inner box back wall. The panel may extend over the entirety of the inner box back wall.

In the container or containers of the present disclosure described above the inner box is disposed within the outer sleeve. Therefore, it could be said that such containers are supplied to a user in a fully assembled condition, where the inner box is disposed within the outer sleeve. However, the present disclosure also contemplates arrangements whereby the inner box is initially supplied separately from the outer sleeve and a user inserts the inner box into the interior of the outer sleeve to form the fully assembled container.

Accordingly, according to the present disclosure, there is provided a kit of parts comprising an outer sleeve and an inner box configured to be received in the outer sleeve to form a container of the present disclosure. The kit of parts may comprise one or more instructions for how to insert the inner box into the outer sleeve to form the fully assembled container. Providing the container in the form of a kit of parts may be advantageous from a manufacturing perspective, because it means that a step of inserting the inner box into the outer sleeve can be performed by a user.

The present disclosure also concerns one or more laminar blanks for forming each of the outer sleeve and inner box of the container described above. Therefore, according to the present disclosure, there is provided a first laminar blank for forming the outer sleeve and a second laminar blank for forming the inner box. The outer sleeve may therefore be formed of a single laminar blank and the inner box may be formed of a separate single laminar blank.

As noted above, containers according to the invention are preferably formed from one or more folded laminar blanks. The one or more laminar blanks may be formed from any suitable material or combination of materials including, but not limited to, cardboard, paperboard, plastic, metal, or combinations thereof. The different components of the container may be formed from the same material, or from different materials. Each of the one or more laminar blanks may be laminar cardboard blank having a weight of between about 100 grams per square metre and about 350 grams per square metre. In preferred embodiments, the blank has a thickness of from about 100 micrometres to about 500 micrometres, preferably from about 200 micrometres to about 350 micrometres.

The container is preferably a rectangular parallelepiped comprising two wider walls (front and back) spaced apart by two narrower side walls. Containers according to the invention may be in the shape of a rectangular parallelepiped, with right-angled longitudinal and right-angled transverse edges. The container may comprise one or more rounded longitudinal edges, rounded transverse edges, bevelled longitudinal edges or bevelled transverse edges, or combinations thereof.

The container may comprise a plurality of consumer goods. The consumer goods may be aerosol-generating articles. The aerosol-generating articles may be filter cigarettes or other smoking articles in which an aerosol-generating substrate comprises a tobacco material that is combusted to form smoke. The aerosol-generating articles may be articles in which a tobacco material is heated to form an aerosol, rather than combusted. The aerosol-generating articles may be articles in which a nicotine-containing aerosol is generated from a tobacco material, tobacco extract, or other nicotine source, without combustion, and in some cases without heating, for example through a chemical reaction.

The aerosol-generating articles may be provided within the container in the form of a bundle wrapped in an inner package formed of metal foil or metallised paper. The inner package material may be formed as a laminate of a metallised polyethylene film, and a liner material. The liner material may be a super-calendered glassine paper. In addition, the inner package material may be provided with a print-receptive top coating. The inner package has an access opening through which aerosol-generating articles can be removed when the lid of the container is in a respective open position.

Through an appropriate choice of the dimensions, containers according to the invention may be designed to hold different total numbers of aerosol-generating articles, or different arrangements of aerosol-generating articles. For example, through an appropriate choice of the dimensions, containers according to the invention may be designed to hold a total of between ten and thirty aerosol-generating articles, such as smoking articles. The aerosol-generating articles may be arranged in different collations, depending on the total number.

The invention will now be further described, by way of example only, with reference to the accompanying drawings in which.

Figure 1:
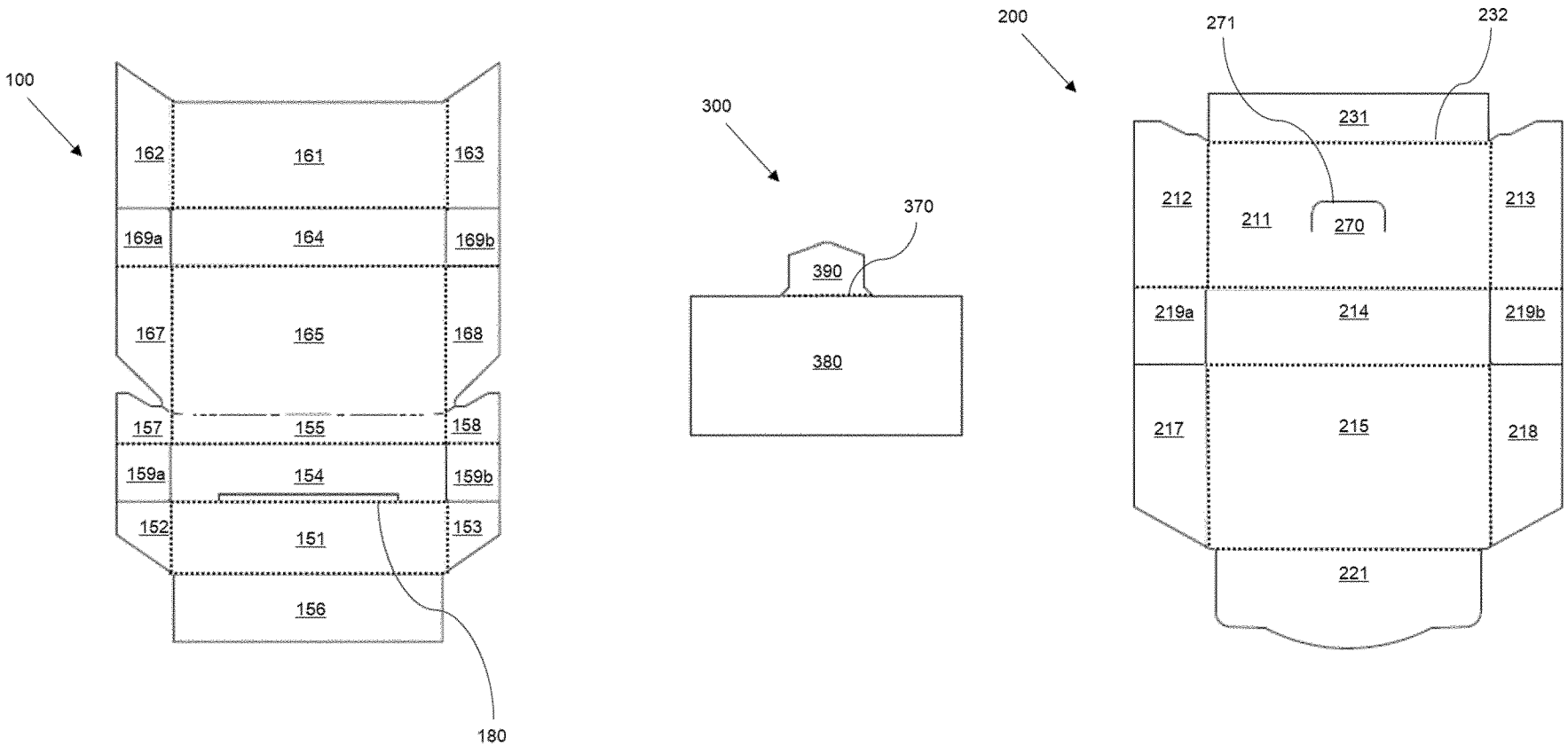
FIG. 1 shows a plurality of laminar blanks for forming a container according to the present invention.

FIG. 1 shows three laminar blanks for forming a container 1 according to the present invention, namely a first laminar blank 100, a second laminar blank 200 and a third laminar blank 300. The laminar blanks can be used to form a container 1 as shown in FIG. 2B.

The first laminar blank 100 and the third laminar blank 300 are configured to form an inner box 10 of the container 1. The inner box 10 comprises a lid portion 50 and a box portion 60.

The dashed lines indicate fold lines, and solid lines indicate cut lines in the laminar blanks. The first laminar blank 100 comprises a lid portion front wall panel 151, first and second lid portion outer side wall panels 152, 153, a lid portion top wall panel 154, a lid portion back wall panel 155, a lid portion front under panel 156, first and second lid portion inner side wall panels 157, 158, and first and second lid portion reinforcement flap panels 159*a*, 159*b*. These panels together form the lid part of the lid portion 50 of the container 1. The lid portion top wall panel 154 includes a slot 180 for receiving a flap 21 of the outer sleeve 20, as will be described in more detail below.

The first laminar blank 100 further comprises a box portion front wall panel 161, first and second box portion outer side wall panels 162, 163, a box portion bottom wall panel 164, a box portion back wall panel 165, first and second box portion inner side wall panels 167, 168 and first and second box portion dust flaps 169*a*, 169*b*. These panels together form the box portion 60 of the container 1.

The second laminar blank 200 comprises an outer sleeve back wall panel 211, first and second outer sleeve outer side wall panels 212, 213, an outer sleeve bottom wall panel 214, an outer sleeve front wall panel 215, first and second outer sleeve inner side wall panels 217, 218, and first and second outer sleeve dust flap panels 219*a*, 219*b*. These panels together form the outer sleeve 20 of the container 1.

The second laminar blank further comprises an outer sleeve flap panel 221 depending from the outer sleeve front wall panel 215. When the outer sleeve 20 is assembled the outer sleeve flap panel 221 forms a flap 21 on the outer sleeve 20. The flap 21 depends from a fold line forming an edge of the outer sleeve front wall 15, the edge being disposed at the outer sleeve opening 25 and the flap 21 extending into the interior of the outer sleeve 20 and away from the outer sleeve back wall 15. This can be best seen from FIG. 2A.

As will be described in more detail below with reference to FIGS. 2A and 2B, the flap 21 on the outer sleeve 20 defines a holding mechanism for preventing the inner box 10 from sliding beyond a set position.

The second laminar blank 200 further comprises an outer sleeve engaging element panel 231. This panel 231 depends from the outer sleeve back wall panel 211. When the outer sleeve 20 is assembled by folding the second laminar blank 200, the outer sleeve engaging element panel 231 is folded about a fold line 232 in the second laminar blank 200, relative to the outer sleeve back wall panel 211. The outer sleeve engaging element panel 231 is then affixed to the inner surface of the outer sleeve back wall 11 to form an engaging element 31 on the inner surface of the outer sleeve back wall 11. The engaging element 31 defines an engagement edge 33 for engaging with a respective inner box engagement flap 39.

The second laminar blank 200 further comprises a portion 270 on the outer sleeve back wall panel 211 for defining a release tab 70 in the outer sleeve back wall 11. This portion 270 is partially delimited by a U-shaped cut line 271 in the outer sleeve back wall panel 211. The release tab 70 is configured to facilitate unlocking of a locking mechanism in the container, as will be described in more detail below with references to FIGS. 3A to 3C.

The third laminar blank 300 is configured to form an inner box engagement flap 39 for the assembled inner box 10. The third laminar blank comprises a first panel 390 for forming the inner box engagement flap 39 and a second panel 380, or securing panel 380, for affixing the inner box engagement flap 39 to the box portion back wall 65 of the inner box 10, for example by way of an adhesive. The first panel 390 is connected to the second panel 380 by way of a fold line 370 in the third laminar blank 300. As shown in FIG. 2A, in the assembled inner box 10, the first panel 390 is folded about this fold line 370 such that it extends away from the box portion back wall 65 of the inner box 10 to form the inner box engagement flap 390.

Figure 2A:
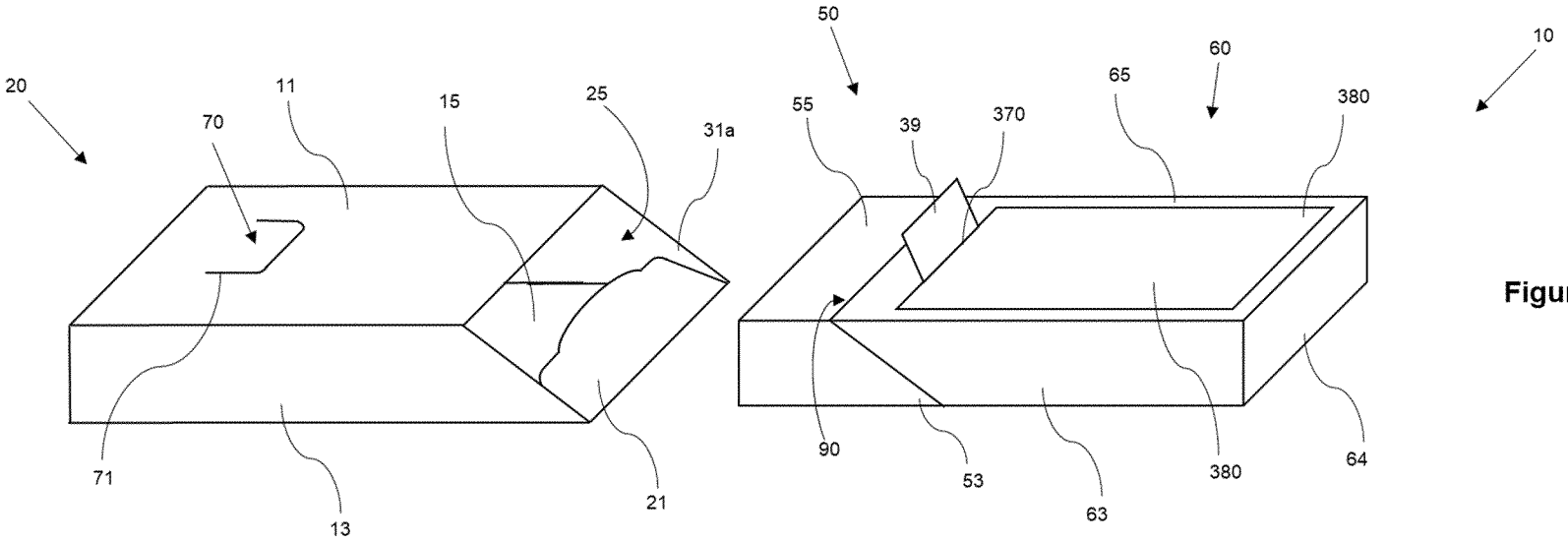
FIG. 2A shows an outer sleeve and an inner box for forming a container according to the present invention.
Figure 2B:
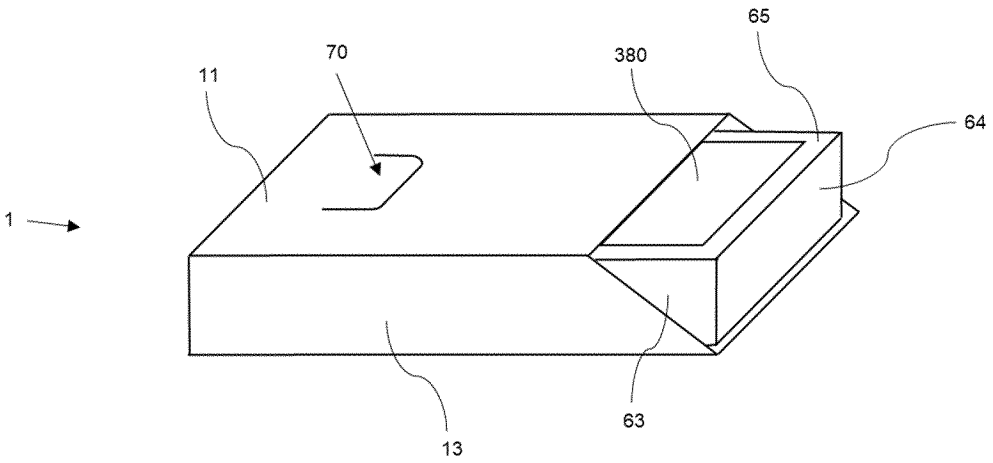
FIG. 2B shows a container according to the present invention.

FIG. 2A shows an outer sleeve 20 and an inner box 10 formed from the laminar blanks of FIG. 1. The outer sleeve comprises an outer sleeve back wall 11, an outer sleeve front wall 15, an outer sleeve bottom wall, a first outer sleeve side wall, a second outer sleeve side wall 13, and an access opening 25 at the opposite end of the outer sleeve 20 to the outer sleeve bottom wall. The outer sleeve back wall 11 is provided with a release tab 70. An outer sleeve flap 21 depends from the edge of the outer sleeve front wall 15 disposed at the first open end 25 of the outer sleeve 20. The outer sleeve flap 21 extends into the interior of the outer sleeve 20 and away from the outer sleeve front wall 15.

The inner box comprises a lid portion 50 and a box portion 60 connected together by a hinge line 90. The lid portion 50 comprises a lid portion top wall, a lid portion front wall, a lid portion back wall 55, a first lid portion side wall, and an opposed second lid portion side wall 53. The box portion 60 comprises a box portion bottom wall 64, a box portion front wall, a box portion back wall 65, a first box portion side wall, and an opposed second box portion side wall 63.

The inner box further comprises an inner box engagement flap 39 configured to overlie a portion of the box portion back wall 65.

The inner box 10 and outer sleeve 20 are shown in FIG. 2A in an unassembled condition. That is, the inner box 10 is external to and separate from the outer sleeve 20. To assemble the inner box 10 and outer sleeve 20 into the container 1 of FIG. 2B, the inner box 10 is passed through the access opening 25 of the outer sleeve 20 and inserted into the interior of the outer sleeve 20. Such insertion causes the outer sleeve flap 21 to be deflected towards the outer sleeve front wall 15, such that the outer sleeve flap 21 lies flush with the outer sleeve front wall 15. Such insertion also causes the inner box engagement flap 39 to be deflected towards the inner box back wall 65, such that the inner box engagement flap 39 lies flush with the second panel 380, or securing panel 380, which is affixed to the outer surface of the inner box back wall 65.

Once the inner box 10 has been fully inserted into the outer sleeve 20 it resides in the position shown in FIG. 2B, namely a first position. In this position, the leading edge of the inner box engagement flap 39 engages with the leading edge of the outer sleeve engaging element panel 231, which is itself secured to the inner surface of the outer sleeve back wall 11. Such engagement acts to prevent the inner box 10 from being slid away from the outer sleeve 20 and thus back out of the access opening 25. The inner box 10 is therefore held in place within the outer sleeve 20 by virtue of such engagement. There is therefore a locking mechanism formed by the inner box 10 and outer sleeve 20, which acts to lock the inner box 10 in the outer sleeve 20 when in the position shown in FIG. 2B. This may be the configuration in which the container 1 is sold to a user.

To unlock the container 1, and thus gain access to the consumer goods, a user must first press the release tab 70 on the outer sleeve back wall 11. This will be described in more detail below with reference to FIGS. 3A, 3B and 3C.

Figure 3A:
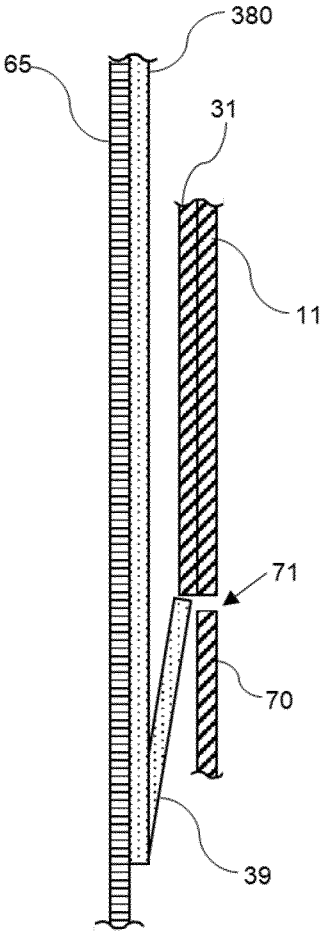
FIGS. 3A to 3C show cross-sectional views of a locking mechanism in different configurations for a container according to the present invention.
Figure 3B:
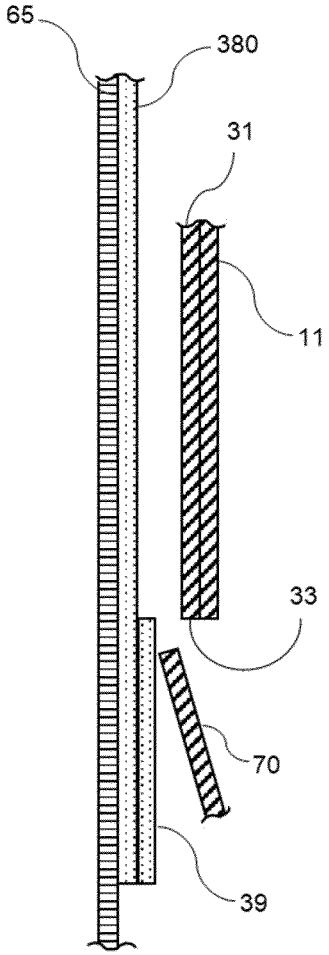
Figure 3C:
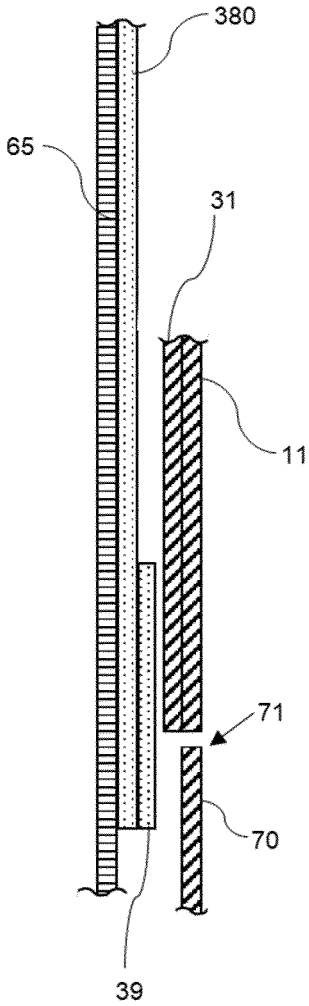

FIGS. 3A to 3C show a partial cross-sectional view of a locking mechanism for a container according to the present invention. The Figures depict the locking mechanism in various configurations.

The locking mechanism comprises the inner box engagement flap 39 and the engaging element 31 of the outer sleeve. The engaging element 31 is formed by the outer sleeve engaging element panel 231, which is secured to the inner surface of the outer sleeve back wall 11. The outer sleeve back wall 11 includes an internal cut line 71, which defines a release tab 70 in the outer sleeve back wall 11. The release tab 70 is positioned to overlie the inner box engagement flap 39, when the inner box 10 is in the first position, as shown in FIG. 3A. The inner box engagement flap 39 depends from a the second panel 380 of the inner box 10, which is secured to the outer surface of the box portion back wall 65 of the inner box 10.

The engaging element 31 has an engaging edge 33, which engages with the leading edge of the inner box engagement flap 39, when the container is in the first position, as shown in FIG. 3A, to prevent the inner box 10 from sliding towards and out of the access opening of the outer sleeve 20.

In FIG. 3A the locking mechanism is in a locked state. To unlock the locking mechanism, a user presses on the release tab 70 to cause it to deflect inwards relative to the outer sleeve 20. The release tab 70 then comes into contact with the inner box engagement flap 39 of the inner box 10 and pushes the inner box engagement flap 39 away from the engaging element 31 of the outer sleeve 20. This causes the leading edge of the inner box engagement flap 39 to disengage from the barrier created by the engaging element 31, as shown in FIG. 3B.

FIG. 3B therefore shows the locking mechanism in an unlocked state, with the inner box 10 still being in the first position relative to the outer sleeve 20. However, because the locking mechanism is now unlocked, the inner box 10 can now move linearly relative to the outer sleeve 20 and towards a second position in which any consumer goods held in the inner box 10 can be accessed by a user. Consequently, after pressing on the release tab 70 and unlocking the locking mechanism, a user can slide the inner box 10 within the outer sleeve 20 to gain access to the consumer goods. Such sliding movement is depicted by the change in position of the inner box 10 components relative to the outer sleeve 20 components between FIGS. 3B and 3C. In particular, the box portion side wall 65, second panel 380, and inner box engagement flap 39 have all been moved upwards in FIG. 3C, relative to their position in FIG. 3B. FIG. 3C therefore shows the locking mechanism in an unlocked state, with the inner box 10 being in the second position.

When the user has finished accessing the consumer goods, the user can slide the inner box 10 back into the interior of the outer sleeve 20. This reverts the inner box engagement flap 39 to a position corresponding to that shown in FIG. 3B. However, as the user is now no longer pressing on the release tab 70, the inner box engagement flap 39 can move back to the position shown in FIG. 3A to engage with the engaging element 31. This results in the locking mechanism reverting to the locked state of FIG. 3A. The inner box engagement flap 39 can automatically revert to the position shown in FIG. 3A in such circumstances, because of the biasing force created by the fold line 370 between the inner box engagement flap 39 and the second panel 380.

As noted above, the outer sleeve 20 comprises a flap 21 which helps to form a holding mechanism for preventing the inner box 10 from sliding beyond a set position. In particular, the flap 21 is configured to engage with the lid portion 50 of the inner box 10, when the inner box 10 is in the second position to prevent the inner box 10 from sliding beyond the second position. In the arrangement of FIGS. 2A and 2B, this is achieved by virtue of the flap 21 sliding into the lid portion 50 as the inner box 10 is moved from the first position to the second position. In particular, as the inner box 10 is moved from the first position to the second position, the flap 21 catches on the lower edge of the lid portion front wall 51 and slides inside the lid portion 50. The flap 21 may remain generally flush with the inner surface of the lid portion front wall 51. When the inner box 10 reaches the second position, the curved part of the leading edge of the flap 21 protrudes through the slot 180 in the lid portion top wall 54. However, the flap 21 and slot 180 are shaped and sized so that some of the leading edge of the flap 21 cannot protrude through the slot 180, but instead engages with the lid portion top wall 54. This engagement prevents the inner box 10 from sliding any further beyond the second position.

The invention claimed is:

1. A container for consumer goods, the container comprising:

an outer sleeve comprising an outer sleeve front wall, an outer sleeve back wall, first and second opposed outer sleeve side walls, an outer sleeve top wall and a first open end; and an inner box comprising a box portion and a lid portion attached to the box portion wherein the lid portion is configured to cover an access opening of the box portion, the inner box disposed within the outer sleeve and configured to be slidable with respect to the outer sleeve between:

a first position, in which an interior of the inner box cannot be accessed by a user; and a second position, in which the interior of the inner box can be accessed by a user through the access opening of the box portion, wherein sliding of the inner box from the first position to the second position involves at least part of the inner box passing through the outer sleeve opening;

wherein the inner box comprises an inner box top wall, an inner box bottom wall, an inner box front wall, an inner box back wall, first and second opposed inner box side walls, and an inner box engagement flap configured to overlie a portion of the outer surface of the respective inner box back wall;

wherein, when the inner box is in the first position in the outer sleeve, an edge of the inner box engagement flap is configured to engage with a corresponding engaging element on the inner surface of the outer sleeve back wall, to form a locking mechanism for preventing the inner box from being slidable from the first position to the second position;

wherein the container further comprises a holding mechanism for preventing the inner box from sliding beyond the second position;

wherein the holding mechanism comprises a flap on the outer sleeve which is configured to engage with a corresponding holding edge on the inner box to prevent the inner box from sliding beyond the second position; and wherein the holding edge on the inner box is formed by an edge of the lid portion of the inner box.

2. The container according to claim 1, wherein the inner box is formed from: a first laminar blank comprising a back wall panel for forming the inner box back wall; and a second laminar blank comprising a first panel for forming the engagement flap and a second panel for securing the first panel to the inner box back wall.

3. The container according to claim 2, wherein the second panel is itself secured to the outer surface of the inner box back wall by an adhesive.

4. The container according to claim 2, wherein the outer sleeve back wall is provided with a release element for enabling the edge of the inner box engagement flap to disengage from the corresponding engaging element of the outer sleeve back wall.

5. The container according to claim 3, wherein the outer sleeve back wall is provided with a release element for enabling the edge of the inner box engagement flap to disengage from the corresponding engaging element of the outer sleeve back wall.

6. The container according to claim 1, wherein the outer sleeve back wall is provided with a release element for enabling the edge of the inner box engagement flap to disengage from the corresponding engaging element of the outer sleeve back wall.

7. The container according to claim 6, wherein the release element comprises a release tab formed by at least one cut-line on the outer sleeve back wall.

8. The container according to claim 6, wherein, when the inner box is in the first position in the outer sleeve, the release element overlies at least a portion of the inner box engagement flap.

9. The container according to claim 7, wherein, when the inner box is in the first position in the outer sleeve, the release element overlies at least a portion of the inner box engagement flap.

10. The container according to claim 1, wherein lid portion comprises a lid portion top wall comprising a slot for engaging with the flap on the outer sleeve when the inner box is in the second position.

11. The container according to claim 1, wherein the inner box engagement flap is configured to pivot about a pivot line on the back wall of the inner box.

12. The container according to claim 1, wherein the inner box comprises:

a box portion comprising a box portion bottom wall, a box portion front wall, a box portion back wall, and first and second opposed box portion side walls;

and a lid portion hingedly attached to the box portion by a hinge line, the lid portion comprising a lid portion top wall, a lid portion front wall, a lid portion back wall, and first and second opposed lid portion side walls, wherein the engagement flap is configured to overlie a portion of the outer surface of the box portion back wall.

13. The container according to claim 12, wherein the container is configured such that: one or both of the hinge line and a lower edge of the lid portion front wall underlies a corresponding one of the outer sleeve front wall and outer sleeve back wall, when the inner box is in the first position.

14. The container according to claim 13, wherein the container is configured such that: one or both of the hinge line and the lower edge of the lid portion front wall is positioned externally of the outer sleeve, when the inner box is in the second position.

15. The container according to claim 1, wherein the corresponding engaging element on the inner surface of the outer sleeve back wall is formed by an edge of a panel affixed to the inner surface of the outer sleeve back wall.

16. The container according to claim 1, wherein the inner box and the outer sleeve are configured such that at least one of the inner box front wall and the inner box back wall completely underlies its corresponding outer sleeve front wall and outer sleeve back wall, when the inner box is in the first position.

* * * * *